US010102820B2

(12) United States Patent
Li

(10) Patent No.: US 10,102,820 B2
(45) Date of Patent: Oct. 16, 2018

(54) GOA CIRCUIT

(71) Applicant: Wuhan China Star Optoelectronics Technology Co., Ltd., Wuhan (CN)

(72) Inventor: Yafeng Li, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 21 days.

(21) Appl. No.: 15/508,106

(22) PCT Filed: Dec. 30, 2016

(86) PCT No.: PCT/CN2016/113324

§ 371 (c)(1),
(2) Date: Mar. 2, 2017

(87) PCT Pub. No.: WO2018/119967

PCT Pub. Date: Jul. 5, 2018

(65) Prior Publication Data

US 2018/0226038 A1 Aug. 9, 2018

(30) Foreign Application Priority Data

Dec. 27, 2016 (CN) ..... 2016 1 1229691

(51) Int. Cl.

| | |
|---|---|
| ***G09G 5/00*** | (2006.01) |
| ***G09G 3/36*** | (2006.01) |
| ***G09G 3/3266*** | (2016.01) |

(52) U.S. Cl.

CPC ..... *G09G 3/3677* (2013.01); *G09G 3/3266* (2013.01); *G09G 2310/0202* (2013.01); *G09G 2310/0283* (2013.01)

(58) Field of Classification Search

CPC ..... G09G 3/3677; G09G 3/3266; G09G 2310/0202; G09G 2310/0283

See application file for complete search history.

(56) References Cited

U.S. PATENT DOCUMENTS

2016/0267832 A1* 9/2016 Dai ..... G09G 3/2092
2018/0151141 A1* 5/2018 Gong ..... G09G 3/3677

* cited by examiner

*Primary Examiner* — Peter D McLoone
(74) *Attorney, Agent, or Firm* — Leong C. Lei

(57) ABSTRACT

The invention provides a GOA circuit, comprising a plurality of GOA units, for a positive integer n, n-th GOA unit comprising: a first TFT (T1), a second TFT (T2), a third TFT (T3), a fourth TFT T(4), a fifth TFT (T5), a sixth TFT (T6), a seventh TFT (T7), an eighth TFT (T8), a ninth TFT (T9), a first capacitor (C1) and a second capacitor (T2). The invention, based on known GOA circuit, uses T8 and T9 connected in parallel between node H and node Qn for conduction. The gate of T8 is connected to Qn−1 (the output signal of the previous GOA unit), and the gate of T9 is connected to Qn+1 (the output signal of the next GOA unit). The invention can provide the function of the known GOA circuit to prevent the stress on TFT T7, can also prevent the output Gn from instability.

13 Claims, 4 Drawing Sheets

GOA CIRCUIT

BACKGROUND OF THE INVENTION

1. Field of the Invention

The present invention relates to the field of display, and in particular to a gate driver on array (GOA) circuit.

2. The Related Arts

As the liquid crystal display (LCD) shows the advantages of high display quality, low power-consumption, thinness, and wide applications, the LCD is widely used in various devices, such as, liquid crystal TV, mobile phones, PDA, digital camera, PC monitors or notebook PC screens, becomes the leading display technology. The low temperature polysilicon (LTPS) is an LCD technology widely used in small or medium-sized electronic products. The LTPS LCD provides the advantages of high resolution, fast response and high aperture rate.

The gate driver on array (GOA) technology is the array substrate column drive technology, by using the array substrate process for the LCD panel to manufacture the driver circuit for the gate scan line on the array substrate to achieve driving of the gates by line-by-line scanning. Correspondingly, the integrated circuit (IC) on the peripheral area of the substrate also attracts attention and much research is taken to explore the system-on-panel (SOP) technology, which gradually takes shape in application.

Refer to FIG. 1. A known GOA circuit is applicable to LTPS panel, and mainly comprises: eight thin film transistors (TFT) and two capacitors. The known GOA circuit comprises: a plurality of cascade GOA units, wherein the n-th GOA unit for outputting n-th scan horizontal scan signal comprising: a TFT T1, having a gate connected to the signal output Gn+1 of the (n+1)th GOA unit, a source and a drain connected respectively to the node H and the constant high voltage VGH; a TFT T2, having a gate connected to the node Q, a source and a drain connected respectively to the signal output Gn of the n-th GOA unit and the input clock signal CKV1; a TFT T3, having a gate connected to the signal output Gn−1 of the (n−1)th GOA unit, a source and a drain connected respectively to the node H and the constant high voltage VGH; a TFT T4, having a gate connected to the node P, a source and a drain connected respectively to the node P and the constant low voltage VGL; a TFT T5, having a gate connected to the input clock signal CKV3, a source and a drain connected respectively to the node P and the constant high voltage VGH; a TFT T6, having a gate connected to the node P, a source and a drain connected respectively to the node H and the constant low voltage VGL; a TFT T7, having a gate connected to the node H, a source and a drain connected respectively to the node P and the constant low voltage VGL; a TFT T8, having a gate connected to the constant high voltage VGH, a source and a drain connected respectively to the node H and the node Q; a capacitor Q1, having two ends connected respectively to the node Q and the signal output Gn; and a capacitor C2, having two ends connected respectively to the node P and the constant low voltage VGL. The node Q is the node controlling the gate driving signal output, and the node P is the stability node maintaining the Q and Gn at low voltage.

Refer to FIG. 2, which shows a schematic view of timing sequence of forward scanning in the GOA circuit of FIG. 1. Also referring to FIG. 1, the forward scanning of the circuit is described as follows:

Stage 1, pre-charging: Gn−1 is at high voltage, T1 is conductive, node H is pre-charged, T8 stays in conductive state, and node Q is pre-charged.

Stage 2, Gn outputting high voltage: in Stage 1, node Q is pre-charged and C1 maintains the charges, T2 is conductive, CKV1 outputs high voltage to Gn.

Stage 3, Gn outputting low voltage: C1 maintains the high voltage of node Q, and the low voltage of CKV1 lowers the Gn; at the same time, Gn+1 is at high voltage, T3 is conducive, and node Q is maintained at high voltage.

Stage 4, node Q lowered to VGL: when CKV3 is at high voltage, T5 is conductive, node P is pulled up, T6 is conductive and node Q is lowered.

Stage 5, node Q and Gn maintained at low voltage: when node Q becomes at low voltage, T7 is cut-off. When CKV3 is at high voltage, node P is charged to high voltage, T4 and T6 are conductive, node Q and Gn are maintained at low voltage.

Refer to FIG. 3, which shows a schematic view of timing sequence of backward scanning in the GOA circuit of FIG. 1. Also referring to FIG. 1, the backward scanning of the circuit is described as follows:

Stage 1, pre-charging: Gn+1 is at high voltage, T3 is conductive, node H is pre-charged, T8 stays in conductive state, and node Q is pre-charged.

Stage 2, Gn outputting high voltage: in Stage 1, node Q is pre-charged and C1 maintains the charges, T2 is conductive, CKV1 outputs high voltage to Gn.

Stage 3, Gn outputting low voltage: C1 maintains the high voltage of node Q, and the low voltage of CKV1 lowers the Gn; at the same time, Gn−1 is at high voltage, T1 is conducive, and node Q is maintained at high voltage.

Stage 4, node Q lowered to VGL: when CKV3 is at high voltage, T5 is conductive, node P is pulled up, T6 is conductive and node Q is lowered.

Stage 5, node Q and Gn maintained at low voltage: when node Q becomes at low voltage, T7 is cut-off. When CKV3 is at high voltage, node P is charged to high voltage, T4 and T6 are conductive, node Q and Gn are maintained at low voltage.

In the known GOA circuit in FIG. 1, for the introducing points, i.e., the node Q and the node H, the node Q is self-raised by C1 when Gn outputs the high voltage. The detailed waveform is shown in FIG. 2 and FIG. 3. To prevent the high voltage of the node Q from imposing onto the node H to cause stress on the TFT T7 during self-raising by C1, the TFT T8 is added between the node Q and the node H, with the gate of TFT T8 connected to VGH. As such, T8 in the GOA circuit always stays conductive. At the maintained low level stage, when the node H leaks current, the effect will be propagated to the node Q and T2 will also leak current to some extent, leading to unstable output Gn, which is an issue must be addressed.

SUMMARY OF THE INVENTION

The object of the present invention is to provide a GOA circuit, based on the known GOA circuit, to solve the issue of unstable output Gn in the known GOA circuit.

To achieve the above object, the present invention provides a GOA circuit, which comprises: a plurality of cascade GOA units, for a positive integer n, the n-th GOA unit comprising:

a first thin film transistor (TFT), having the source and the drain connected respectively to a first node and a constant high voltage VGH, when the n-th GOA unit not the first GOA unit in the cascade, having the gate connected to a signal output of the (n−1)th GOA unit; otherwise, the gate connected to a first start signal;

a third TFT, having a source and a drain connected respectively to the first node and the constant high voltage VGH, when the n-th GOA unit not the last GOA unit in the cascade, having a gate connected to a signal output of (n+1)th GOA unit; otherwise, the gate connected to a second start signal;

a seventh TFT, having a gate connected to the first node, a source and a drain connected respectively to a third node and a constant low voltage VGL;

a sixth TFT, having a gate connected to the third node, ae source and ae drain connected respectively to the first node and the constant low voltage VGL;

a fifth TFT, having a gate connected to a second clock signal, a source and a drain connected respectively to the third node and the constant high voltage VGH;

a fourth TFT, having a gate connected to the third node, a source and a drain connected respectively to the output signal of n-th GOA unit and the constant low voltage VGL;

a second TFT, having a gate connected to a second node of n-th GOA unit, a source and a drain connected respectively to the output signal of n-th GOA unit and inputted a first clock signal;

an eighth TFT, having a source and a drain connected respectively to the first node and the second node of n-th GOA unit, when the n-th GOA unit not the first GOA unit in the cascade, having a gate connected to the second node of (n−1)th GOA unit; otherwise, the gate connected to a third start signal;

a ninth TFT, having a source and a drain connected respectively to the first node and the second node of n-th GOA unit, when the n-th GOA unit not the last GOA unit in the cascade, having a gate connected to the second node of (n+1)th GOA unit; otherwise, the gate connected to a fourth start signal;

a first capacitor, having a two ends connected respectively to the second node of n-th GOA unit and the output signal of n-th GOA unit;

a second capacitor, having a two ends connected respectively to the third node and the constant low voltage VGL.

According to a preferred embodiment of the present invention, both the first clock signal and the second clock signal are rectangular waves having a duty ratio of 0.25, and the waveforms between the first clock signal and the second clock signal differ by a half cycle.

According to a preferred embodiment of the present invention, for the first GOA unit in the cascade, during forward scanning, the first start signal is at high voltage; when the first start signal becomes low voltage, the output signal of n-th GOA unit become high voltage.

According to a preferred embodiment of the present invention, for the last GOA unit in the cascade, during backward scanning, the second start signal is at high voltage; when the second start signal becomes low voltage, the output signal of n-th GOA unit become high voltage.

According to a preferred embodiment of the present invention, for the first GOA unit in the cascade, during forward scanning, when the first start signal is at high voltage, the third start signal is high voltage.

According to a preferred embodiment of the present invention, for the last GOA unit in the cascade, during backward scanning, when the second start signal is at high voltage, the fourth start signal is high voltage.

According to a preferred embodiment of the present invention, the GOA circuit is for low temperature polysilicon (LPTS) panel.

According to a preferred embodiment of the present invention, the GOA circuit is for organic light-emitting diode (OLED) panel.

The present invention also provides a GOA circuit, which comprises: a plurality of cascade GOA units, for a positive integer n, the n-th GOA unit comprising:

a first thin film transistor (TFT), having a source and a drain connected respectively to a first node and a constant high voltage VGH, when the n-th GOA unit not the first GOA unit in the cascade, having a gate connected to a signal output of the (n−1)th GOA unit; otherwise, the gate connected to a first start signal;

a third TFT, having a source and a drain connected respectively to the first node and the constant high voltage VGH, when the n-th GOA unit not the last GOA unit in the cascade, having a gate connected to a signal output of (n+1)th GOA unit; otherwise, the gate connected to a second start signal;

a seventh TFT, having a gate connected to the first node, a source and a drain connected respectively to a third node and a constant low voltage VGL;

a sixth TFT, having a gate connected to the third node, a source and a drain connected respectively to the first node and the constant low voltage VGL;

a fifth TFT, having a gate connected to a second clock signal, a source and a drain connected respectively to the third node and the constant high voltage VGH;

a fourth TFT, having a gate connected to the third node, ae source and a drain connected respectively to the output signal of n-th GOA unit and the constant low voltage VGL;

a second TFT, having a gate connected to a second node of n-th GOA unit, a source and ae drain connected respectively to the output signal of n-th GOA unit and inputted a first clock signal;

an eighth TFT, having a source and a drain connected respectively to the first node and the second node of n-th GOA unit, when the n-th GOA unit not the first GOA unit in the cascade, having a gate connected to the second node of (n−1)th GOA unit; otherwise, the gate connected to a third start signal;

a ninth TFT, having a source and a drain connected respectively to the first node and the second node of n-th GOA unit, when the n-th GOA unit not the last GOA unit in the cascade, having a gate connected to the second node of (n+1)th GOA unit; otherwise, the gate connected to a fourth start signal;

a first capacitor, having two ends connected respectively to the second node of n-th GOA unit and the output signal of n-th GOA unit;

a second capacitor, having two ends connected respectively to the third node and the constant low voltage VGL;

wherein both the first clock signal and the second clock signal being rectangular waves having a duty ratio of 0.25, and the waveforms between the first clock signal and the second clock signal differing by a half cycle;

wherein the GOA circuit being for low temperature polysilicon (LPTS) panel.

Compared to the known techniques, the present invention provides the following advantages: the GOA circuit of the present invention not only provides the function of known GOA circuit to prevent the stress on the TFT T7, can also prevent output Gn from instability.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 1:
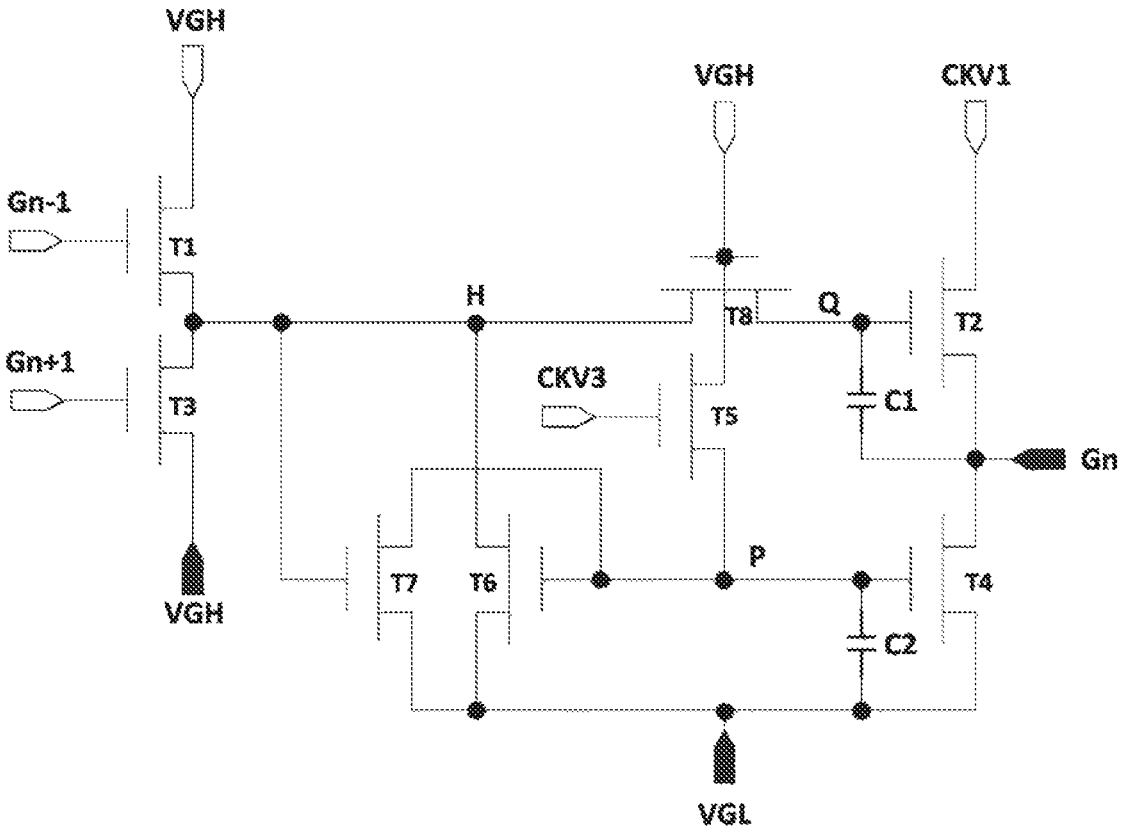
FIG. 1 is a schematic view showing a known GOA circuit.
Figure 2:
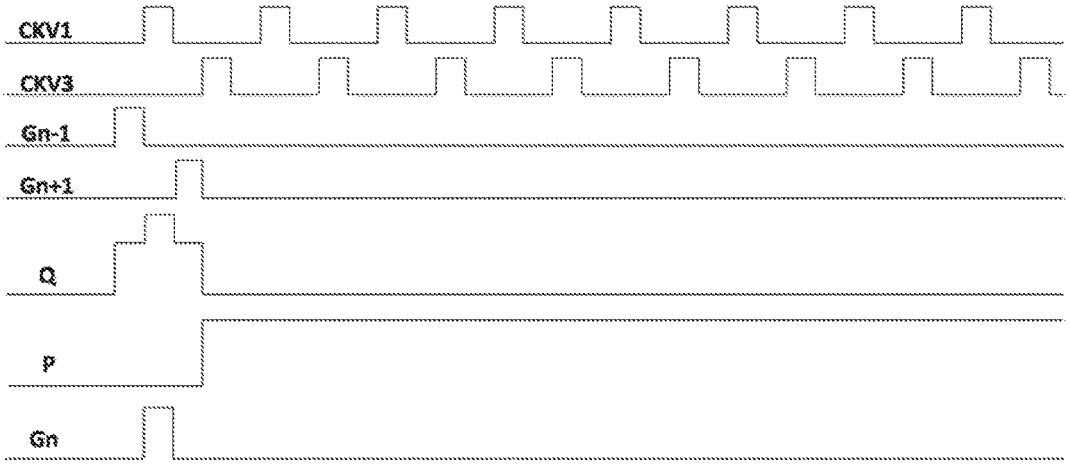
FIG. 2 is a schematic view showing the forward scanning timing for the GOA circuit of FIG. 1.
Figure 3:
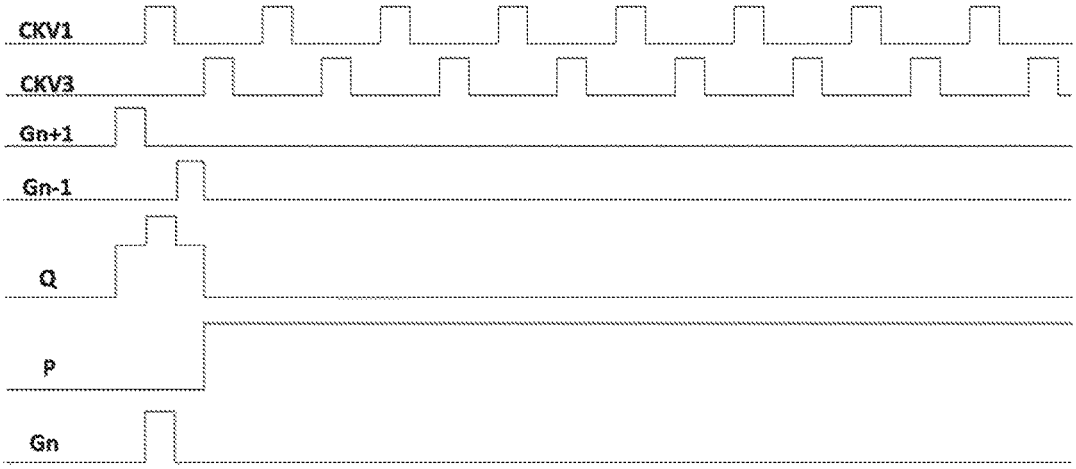
FIG. 3 is a schematic view showing the backward scanning timing for the GOA circuit of FIG. 1.
Figure 4:
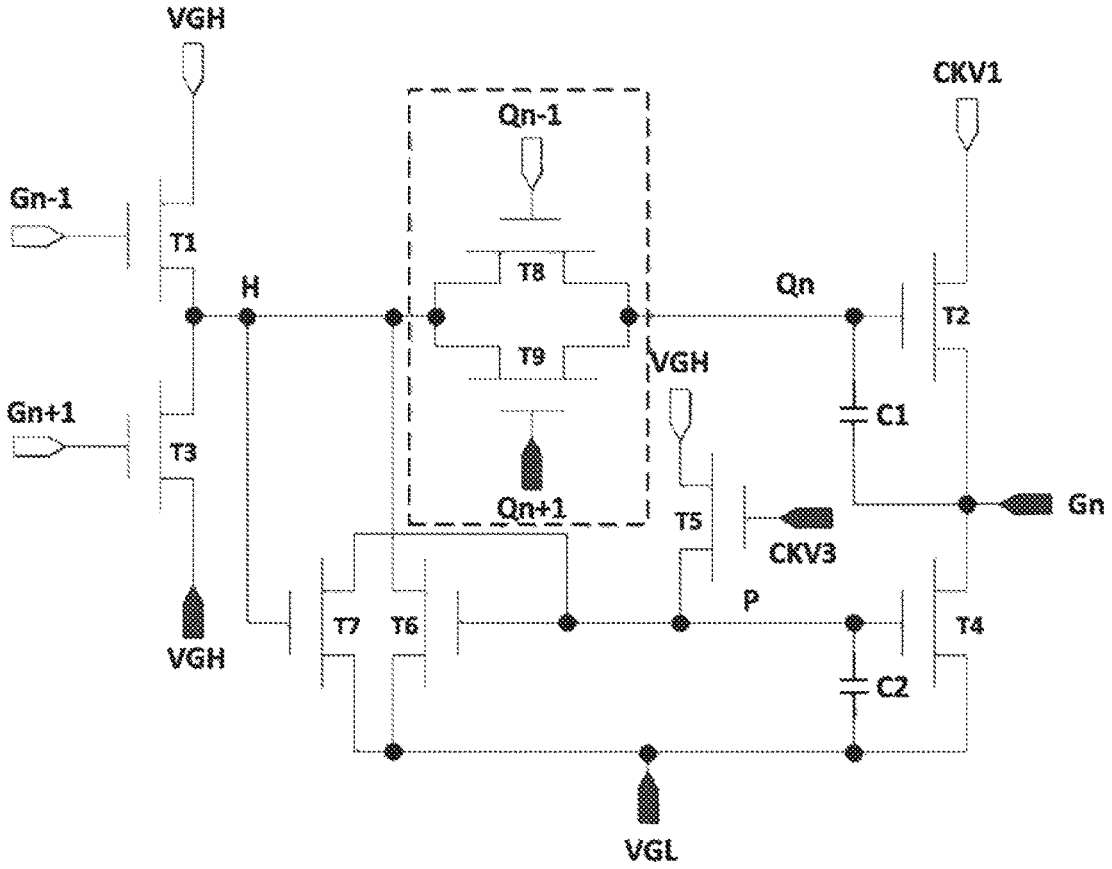
FIG. 4 is a schematic view showing the GOA circuit provided by an embodiment of the present invention.

Refer to FIG. 4. The present invention provides a GOA circuit, applicable to an LTPS panel. The GOA circuit comprises: a plurality of cascade GOA units, for a positive integer n, the n-th GOA unit comprising: a first thin film transistor (TFT) T1, when the n-th GOA unit not the first GOA unit in the cascade, having a gate connected to a signal output Gn−1 of the (n−1)th GOA unit, and having a source and a drain connected respectively to a first node H and a constant high voltage VGH; a second TFT T2, having a gate connected to a second node Qn of n-th GOA unit, a source and a drain connected respectively to the output signal Gn of n-th GOA unit and inputted a first clock signal CKV1; a third TFT T3, when the n-th GOA unit not the last GOA unit in the cascade, having a gate connected to a signal output Gn+1 of (n+1)th GOA unit, a source and a drain connected respectively to the first node H and the constant high voltage VGH; a fourth TFT T4, having a gate connected to a third node P, a source and a drain connected respectively to the output signal Gn of n-th GOA unit and a constant low voltage VGL; a fifth TFT T5, having a gate connected to a second clock signal CKV3, a source and a drain connected respectively to the third node P and the constant high voltage VGH; a sixth TFT T6, having a gate connected to the third node P, a source and a drain connected respectively to the first node H and the constant low voltage VGL; a seventh TFT, having a gate connected to the first node H, a source and a drain connected respectively to the third node P and the constant low voltage VGL; an eighth TFT T8, when the n-th GOA unit not the first GOA unit in the cascade, having a gate connected to the second node Qn−1 of (n−1)th GOA unit, a source and a drain connected respectively to the first node H and the second node Qn of n-th GOA unit; a ninth TFT T9, when the n-th GOA unit not the last GOA unit in the cascade, having a gate connected to the second node Qn−1 of (n+1)th GOA unit, a source and a drain connected respectively to the first node H and the second node Qn of n-th GOA unit; a first capacitor C1, having two ends connected respectively to the second node Qn of n-th GOA unit and the output signal Gn of n-th GOA unit; and a second capacitor C2, having e two ends connected respectively to the third node P and the constant low voltage VGL.

Figure 5:
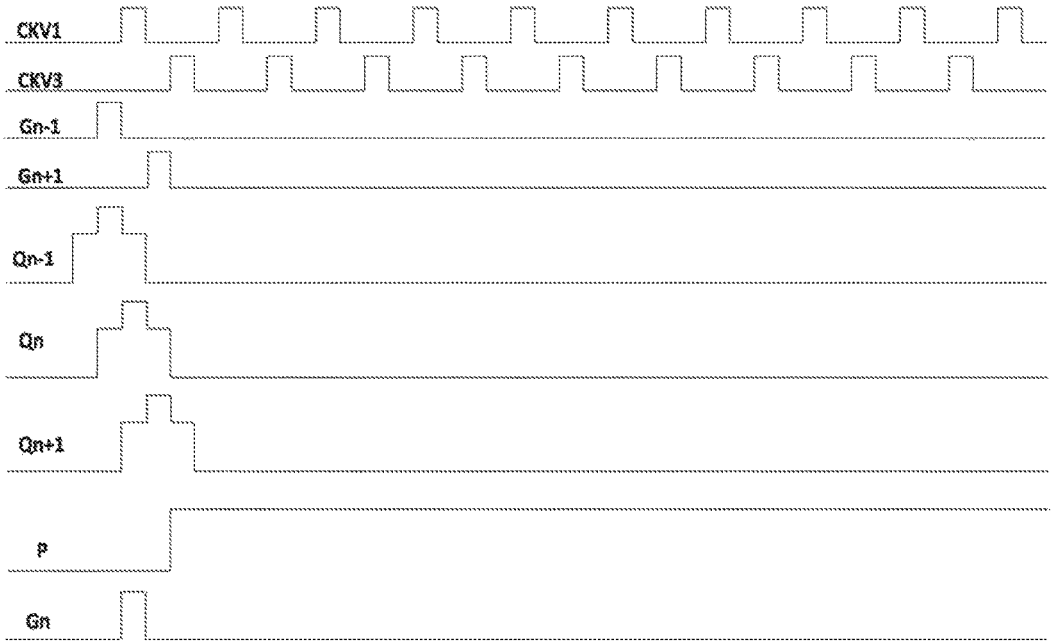
FIG. 5 is a schematic view showing the forward scanning timing for GOA circuit of FIG. 4.

Refer to FIG. 5, which shows a schematic view of timing sequence of forward scanning in the GOA circuit of FIG. 4. Also referring to FIG. 4, the forward scanning of the circuit is described as follows:

Stage 1, pre-charging: Gn−1 is at high voltage, T1 is conductive, the node H is pre-charged, at this point Qn−1 is at high voltage, T8 stays in conductive state, and the node Qn is pre-charged.

Stage 2, Gn outputting high voltage: in Stage 1, the node Qn is pre-charged and C1 maintains the charges, T2 is conductive, CKV1 outputs high voltage to Gn.

Stage 3, Gn outputting low voltage: C1 maintains the high voltage of node Qn, and the low voltage of CKV1 lowers the Gn; at the same time, Gn+1 is at high voltage, T3 is conducive, and node Qn is maintained at high voltage.

Stage 4, node Qn lowered to VGL: when CKV3 is at high voltage, T5 is conductive, node P is pulled up, T6 is conductive and node Qn is lowered.

Stage 5, node Qn and Gn maintained at low voltage: when node Qn becomes at low voltage, T7 is cut-off. When CKV3 is at high voltage, node P is charged to high voltage, T4 and T6 are conductive, node Qn and Gn are maintained at low voltage.

As shown in FIG. 5, both the clock signal CKV1 and the clock signal CKV3 are rectangular waves having a duty ratio of 0.25, and the waveforms between the clock signal CKV1 and the clock signal CKV3 differ by a half cycle.

The present invention uses input start signals to replace the missing signal input for the first and the last GOA units in the cascade. During forward scanning, when n is 1, i.e., in the first GOA unit, the gate of T1 is connected to a first start signal, initially at high voltage; when the start signal becomes low voltage, the output signal Gn becomes high voltage.

In the first GOA unit, during forward scanning, when the first start signal is at high voltage, the third start signal inputted to the gate of T8 is at high voltage.

Figure 6:
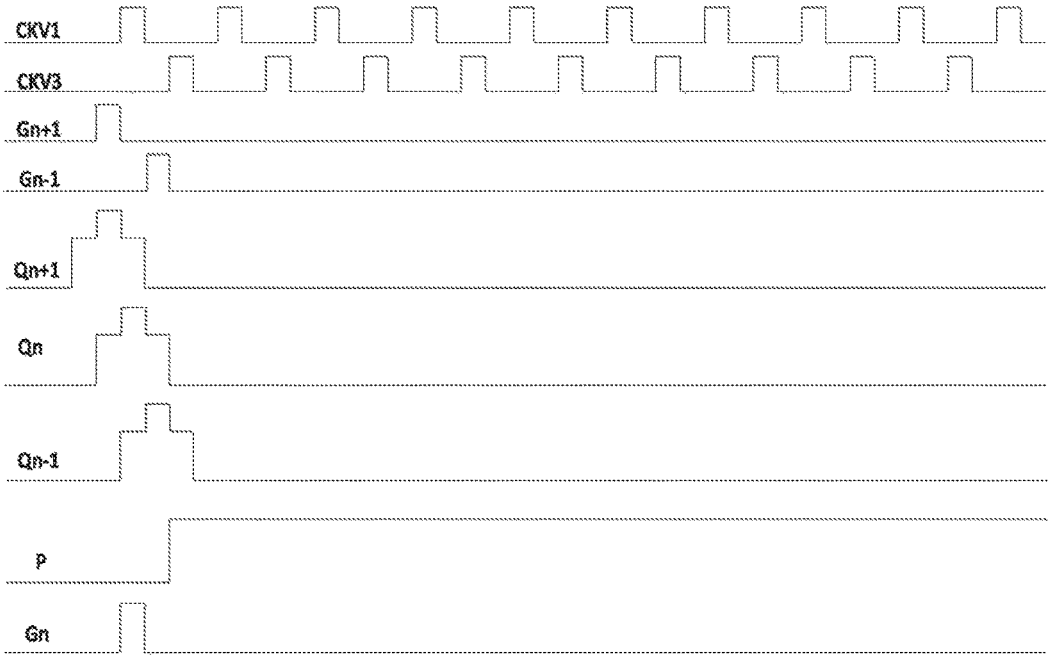
FIG. 6 is a schematic view showing the backward scanning timing for GOA circuit of FIG. 4.

Refer to FIG. 6, which shows a schematic view of timing sequence of backward scanning in the GOA circuit of FIG. 4. Also referring to FIG. 4, the backward scanning of the circuit is described as follows:

Stage 1, pre-charging: Gn+1 is at high voltage, T3 is conductive, the node H is pre-charged, at this point, Qn+1 is at high voltage, T9 stays in conductive state, and node Qn is pre-charged.

Stage 2, Gn outputting high voltage: in Stage 1, the node Qn is pre-charged and C1 maintains the charges, T2 is conductive, CKV1 outputs high voltage to Gn.

Stage 3, Gn outputting low voltage: C1 maintains the high voltage of node Qn, and the low voltage of CKV1 lowers the Gn; at the same time, Gn−1 is at high voltage, T1 is conducive, and node Qn is maintained at high voltage.

Stage 4, node Qn lowered to VGL: when CKV3 is at high voltage, T5 is conductive, node P is pulled up, T6 is conductive and node Qn is lowered.

Stage 5, node Qn and Gn maintained at low voltage: when node Qn becomes at low voltage, T7 is cut-off. When CKV3 is at high voltage, node P is charged to high voltage, T4 and T6 are conductive, node Qn and Gn are maintained at low voltage.

As shown in FIG. 6, both the clock signal CKV1 and the clock signal CKV3 are rectangular waves having a duty ratio of 0.25, and the waveforms between the clock signal CKV1 and the clock signal CKV3 differ by a half cycle.

The present invention uses input start signals to replace the missing signal input for the first and the last GOA units in the cascade. During forward scanning, when n-th GOA unit is the last GOA unit in the cascade, the gate of T3 is connected to a second start signal, initially at high voltage; when the start signal becomes low voltage, the output signal Gn becomes high voltage.

In the last GOA unit, during backward scanning, when the second start signal is at high voltage, the fourth start signal inputted to the gate of T9 is at high voltage.

As shown in dashed box of FIG. 4, based on the known GOA circuit, the present invention uses T8 and T9 connected in parallel between node H and node Qn for conduction. The gate of T8 is connected to Qn−1 (the output signal of the previous GOA unit), and the gate of T9 is connected to Qn+1 (the output signal of the next GOA unit). Because Qn is at low voltage most of the time other than when Gn outputs high voltage, this new connection can provide the function of the known GOA circuit to prevent the stress on TFT T7 caused by the imposition from the Qn on the node H when Qn self-raised. Moreover, the new connection can also prevent, during the low voltage maintenance stage, the current leakage at node H from propagating to Qn. At some extent, T2 leaks current and causes the output Gn unstable.

The GOA circuit of the present invention can be applied and potentially applied to the following: 1, integrated gate driver circuit on the array substrate of LCD; 2, the gate driving for mobile phones, displays and TVs; 3, advanced technology for LCD and OLED industry; and 4, the circuit stability of the present invention applicable to high-resolution panel.

In summary, the GOA circuit of the present invention not only can provide the function of known GOA circuit to prevent TFT T7 from stress, but also prevent output signal Gn from instability.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A gate driver on array (GOA) circuit, which comprises: a plurality of cascade GOA units, for a positive integer n, the n-th GOA unit comprising:

a first thin film transistor (TFT), having a source and a drain connected respectively to a first node and a constant high voltage VGH, when the n-th GOA unit not the first GOA unit in the cascade, having a gate connected to a signal output of the (n−1)th GOA unit; otherwise, the gate connected to a first start signal;

a third TFT, having a source and a drain connected respectively to the first node and the constant high voltage VGH, when the n-th GOA unit not the last GOA unit in the cascade, having a gate connected to a signal output of (n+1)th GOA unit; otherwise, the gate connected to a second start signal;

a seventh TFT, having a gate connected to the first node, a source and a drain connected respectively to a third node and a constant low voltage VGL;

a sixth TFT, having a gate connected to the third node, a source and a drain connected respectively to the first node and the constant low voltage VGL;

a fifth TFT, having a gate connected to a second clock signal, a source and a drain connected respectively to the third node and the constant high voltage VGH;

a fourth TFT, having a gate connected to the third node, a source and a drain connected respectively to the output signal of n-th GOA unit and the constant low voltage VGL;

a second TFT, having a gate connected to a second node of n-th GOA unit, a source and a drain connected respectively to the output signal of n-th GOA unit and inputted a first clock signal;

an eighth TFT, having a source and a drain connected respectively to the first node and the second node of n-th GOA unit, when the n-th GOA unit not the first GOA unit in the cascade, having a gate connected to the second node of (n−1)th GOA unit; otherwise, the gate connected to a third start signal;

a ninth TFT, having a source and a drain connected respectively to the first node and the second node of n-th GOA unit, when the n-th GOA unit not the last GOA unit in the cascade, having a gate connected to the second node of (n+1)th GOA unit; otherwise, the gate connected to a fourth start signal;

a first capacitor, having two ends connected respectively to the second node of n-th GOA unit and the output signal of n-th GOA unit; and a second capacitor, having two ends connected respectively to the third node and the constant low voltage VGL.

2. The GOA circuit as claimed in claim 1, wherein the first clock signal and the second clock signal are rectangular waves having a duty ratio of 0.25, and the waveforms between the first clock signal and the second clock signal differ by a half cycle.

3. The GOA circuit as claimed in claim 1, wherein for the first GOA unit in the cascade, during forward scanning, the first start signal is at high voltage; when the first start signal becomes low voltage, the output signal of n-th GOA unit become high voltage.

4. The GOA circuit as claimed in claim 1, wherein for the last GOA unit in the cascade, during backward scanning, the second start signal is at high voltage; when the second start signal becomes low voltage, the output signal of n-th GOA unit become high voltage.

5. The GOA circuit as claimed in claim 1, wherein for the first GOA unit in the cascade, during forward scanning, when the first start signal is at high voltage, the third start signal is high voltage.

6. The GOA circuit as claimed in claim 1, wherein for the last GOA unit in the cascade, during backward scanning, when the second start signal is at high voltage, the fourth start signal is high voltage.

7. The GOA circuit as claimed in claim 1, wherein the GOA circuit is for low temperature polysilicon (LPTS) panel.

8. The GOA circuit as claimed in claim 1, wherein the GOA circuit is for organic light-emitting diode (OLED) panel.

9. A gate driver on array (GOA) circuit, which comprises: a plurality of cascade GOA units, for a positive integer n, the n-th GOA unit comprising:

a first thin film transistor (TFT), having a source and a drain connected respectively to a first node and a constant high voltage VGH, when the n-th GOA unit not the first GOA unit in the cascade, having a gate connected to a signal output of the (n−1)th GOA unit; otherwise, the gate connected to a first start signal;

a third TFT, having a source and a drain connected respectively to the first node and the constant high voltage VGH, when the n-th GOA unit not the last GOA unit in the cascade, having a gate connected to a signal output of (n+1)th GOA unit; otherwise, the gate connected to a second start signal;

a seventh TFT, having a gate connected to the first node, a source and a drain connected respectively to a third node and a constant low voltage VGL;

a sixth TFT, having a gate connected to the third node, a source and a drain connected respectively to the first node and the constant low voltage VGL;

a fifth TFT, having a gate connected to a second clock signal, a source and a drain connected respectively to the third node and the constant high voltage VGH;

a fourth TFT, having a gate connected to the third node, a source and a drain connected respectively to the output signal of n-th GOA unit and the constant low voltage VGL;

a second TFT, having a gate connected to a second node of n-th GOA unit, a source and a drain connected respectively to the output signal of n-th GOA unit and inputted a first clock signal;

an eighth TFT, having a source and a drain connected respectively to the first node and the second node of n-th GOA unit, when the n-th GOA unit not the first GOA unit in the cascade, having a gate connected to the second node of (n−1)th GOA unit; otherwise, the gate connected to a third start signal;

a ninth TFT, having a source and a drain connected respectively to the first node and the second node of n-th GOA unit, when the n-th GOA unit not the last GOA unit in the cascade, having a gate connected to the second node of (n+1)th GOA unit; otherwise, the gate connected to a fourth start signal;

a first capacitor, having two ends connected respectively to the second node of n-th GOA unit and the output signal of n-th GOA unit; and a second capacitor, having two ends connected respectively to the third node and the constant low voltage VGL;

wherein the first clock signal and the second clock signal being rectangular waves having a duty ratio of 0.25, and the waveforms between the first clock signal and the second clock signal differing by a half cycle;

wherein the GOA circuit being for low temperature polysilicon (LPTS) panel.

10. The GOA circuit as claimed in claim 9, wherein for the first GOA unit in the cascade, during forward scanning, the first start signal is at high voltage; when the first start signal becomes low voltage, the output signal of n-th GOA unit become high voltage.

11. The GOA circuit as claimed in claim 9, wherein for the last GOA unit in the cascade, during backward scanning, the second start signal is at high voltage; when the second start signal becomes low voltage, the output signal of n-th GOA unit become high voltage.

12. The GOA circuit as claimed in claim 9, wherein for the first GOA unit in the cascade, during forward scanning, when the first start signal is at high voltage, the third start signal is high voltage.

13. The GOA circuit as claimed in claim 9, wherein for the last GOA unit in the cascade, during backward scanning, when the second start signal is at high voltage, the fourth start signal is high voltage.

* * * * *